US007795562B2

(12) United States Patent
de Rooij et al.

(10) Patent No.: US 7,795,562 B2
(45) **Date of Patent: *Sep. 14, 2010**

(54) DUAL COIL INDUCTION HEATING SYSTEM

(75) Inventors: Michael Andrew de Rooij, Clifton Park, NY (US); John Stanley Glaser, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 481 days.

This patent is subject to a terminal disclaimer.

(21) Appl. No.: 11/338,459

(22) Filed: Jan. 24, 2006

(65) Prior Publication Data

US 2006/0118550 A1 Jun. 8, 2006

Related U.S. Application Data

(63) Continuation of application No. 10/650,144, filed on Aug. 26, 2003, now Pat. No. 7,022,952.

(51) Int. Cl.
*H05B 6/10* (2006.01)
*H01F 21/02* (2006.01)

(52) U.S. Cl. ..... 219/624; 336/146

(58) Field of Classification Search ..... 219/623–677, 219/618, 619, 620, 621, 622; 336/147, 145, 336/186, 146

See application file for complete search history.

(56) References Cited

U.S. PATENT DOCUMENTS 3,814,888 A 6/1974 Bowers et al.
4,074,101 A * 2/1978 Kiuchi et al. ..... 219/601
4,241,250 A 12/1980 Steigerwald
4,300,031 A * 11/1981 Reboux et al. ..... 219/617
4,520,818 A * 6/1985 Mickiewicz ..... 606/40
4,542,273 A * 9/1985 Hirata ..... 219/662

(Continued)

FOREIGN PATENT DOCUMENTS

JP 96273822 A 10/1996

(Continued)

OTHER PUBLICATIONS

Tanaka, Teruya, A New Induction Cooking Range for Heating Any Kind of Metal Vessels, Jun. 9, 1989, pp. 635-641, Yokohama, Japan.

*Primary Examiner*—Daniel L Robinson
(74) *Attorney, Agent, or Firm*—Richard D. Emery

(57) ABSTRACT

A dual coil induction cooking system and method for heating ferrous and non-ferrous cooking vessels. The system includes a first resonant circuit for inducing a current in a ferrous metal cooking vessel at a first frequency and a second resonant circuit, wired in a parallel combination with the first resonant circuit, for inducing a current in a non-ferrous metal cooking vessel at a second frequency. The system also includes a power source for powering the parallel combination, so that one of the first and the second resonant circuits is coupled to supply power through the parallel combination to a respective one of the cooking vessels. A method for coupling power to a load includes sweeping a parallel combination of resonant circuits with a variable frequency power, detecting a resonant frequency response corresponding to a metallic composition of the load, and simultaneously powering the parallel combination of resonant circuits at a frequency corresponding to the detected resonant frequency.

13 Claims, 3 Drawing Sheets

U.S. PATENT DOCUMENTS

| | | | | |
|---|---|---|---|---|
| 4,749,836 | A | 6/1988 | Matsuo et al. | |
| 4,820,891 | A * | 4/1989 | Tanaka et al. | 219/626 |
| 6,696,770 | B2 * | 2/2004 | Nadot et al. | 307/17 |
| 6,770,857 | B2 * | 8/2004 | Hirota et al. | 219/626 |
| 7,022,952 | B2 * | 4/2006 | de Rooij et al. | 219/624 |
| 2003/0164373 | A1 * | 9/2003 | Hirota et al. | 219/664 |
| 2006/0118549 | A1 * | 6/2006 | Fishman et al. | 219/656 |
| 2007/0102420 | A1 * | 5/2007 | Miyauchi et al. | 219/626 |

FOREIGN PATENT DOCUMENTS

| | | | |
|---|---|---|---|
| JP | 97063761 | A | 3/1997 |

* cited by examiner

DUAL COIL INDUCTION HEATING SYSTEM

CROSS REFERENCE TO RELATED APPLICATIONS

This application is a Continuation of application Ser. No. 10/650,144, filed Aug. 26, 2003 now U.S. Pat. No. 7,022,952, entitled, "DUAL COIL INDUCTION HEATING SYSTEM."

FIELD OF THE INVENTION

The present invention is generally related to cooking appliances, and, more particularly, to a dual coil induction-cooking system for heating electrically conductive cooking vessels.

BACKGROUND OF THE INVENTION

Induction cooking systems work according to the principle of electromagnetic induction by inducing a current into the base of an electrically conductive cooking vessel, such as a pan, pot, or skillet. The current induced in the base of the cooking vessel causes the cooking vessel to heat up as the cooking vessel exhibits resistance to the induced current, thereby cooking food placed in the cooking vessel or heating water in the cooking vessel. The current is typically induced by a coil placed beneath the cooking vessel. An alternating current (AC), such as an AC current operating at, but not limited to, a frequency of 20 kilohertz or greater, for example, produced by an inverter, is supplied to the coil. Accordingly, a magnetic field is generated by the AC current in the coil. The generated magnetic field induces a current that flows in the base of the cooking vessel. In the past, induction cooking systems have been limited to the use of ferrous metal cooking vessels, such as iron or ferrous stainless steel cookers, due to the high current and/or high frequencies required to produce a sufficient heating effect in non-ferrous cooking vessels. For example, non-ferrous cooking vessels, such as aluminum or copper cooking vessels, typically require comparatively higher currents compared to ferrous metal based cooking vessels. Dual coil arrangements, including one coil for ferrous cookers, and one coil for non-ferrous cookers, have been proposed, but systems employing these dual coil arrangements are believed to be inefficient, unreliable, complex to manufacture, and expensive.

SUMMARY OF THE INVENTION

A dual coil induction cooking system is presented that includes a first resonant circuit for inducing a current in a ferrous metal cooking vessel at a first frequency. The system also includes a second resonant circuit, connected in a parallel combination with the first resonant circuit, for inducing a current in a non-ferrous metal cooking vessel at a second frequency. The system further includes a frequency source for powering the parallel combination, without changing a wiring arrangement to the parallel combination, so that both the first and the second resonant circuits are coupled to supply power through the parallel combination to a respective cooking vessel.

A method is provided for coupling power to a conductive load in an induction cooking system. The induction cooking system includes two cooking coil resonant circuits powered by a variable frequency power source. The method allows sweeping at least one of the resonant circuits with a variable frequency power. The method also allows detecting a resonant frequency response corresponding to the interaction between the load and at least one of the resonant circuits. The method further allows powering at least one of the resonant circuits at a frequency corresponding to the detected resonant frequency.

DETAILED DESCRIPTION OF THE INVENTION

Figure 1:
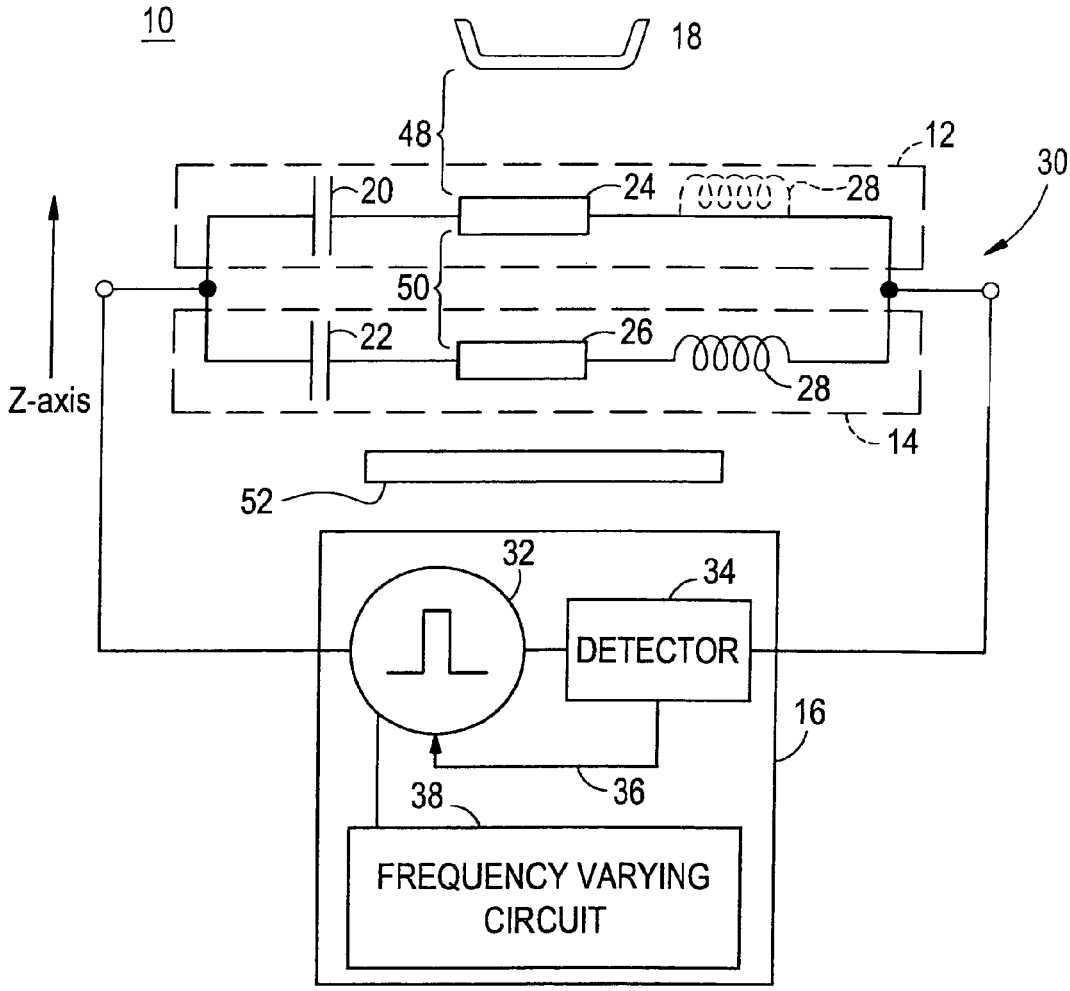
FIG. 1 is an exemplary diagram of a dual coil induction cooking system for electrically conductive cooking vessels.

FIG. 1 is an exemplary diagram 10 of a dual coil induction cooking system for electrically conductive cooking vessels, such as cooking vessels including ferrous metal conductors, non-ferrous metals conductors, or a combination of ferrous and nonferrous metals conductors. Generally, the circuit 10 may include a non-ferrous metal resonant circuit 12, a ferrous metal resonant circuit 14, wired, for example, in a parallel combination 30 with the non-ferrous metal resonant circuit 12. The circuit 10 may also include a frequency source 16 for powering the parallel combination 30 of the non-ferrous metal resonant circuit 12 and the ferrous metal resonant circuit 14. The non-ferrous metal resonant circuit 12 may include a capacitor 20 and a non-ferrous metal cooking vessel coil 24, for example, wired in series. The ferrous metal resonant circuit 14 may include a ferrous metal cooking vessel coil 26 wired in series with a capacitor 22. An additional inductor 28, external to the coil 26, and wired in series with the capacitor 22 and the ferrous cooking coil 26, may be used to match resonant impedance differences (for example, at the respective resonant frequency of operation) between the non-ferrous metal resonant circuit 12 and the ferrous metal resonant circuit 14. In an aspect of the invention, the additional inductor 28 may be wired in series with the capacitor 20 and the ferrous cooking coil 24. A core 52 may be provided proximate the coils 24, 26 to shield the other electronics and exposed metal parts of the cooking appliance from the parallel combination 30 and to increase the magnetizing inductance of the coils 24, 26, thereby reducing an excitation current required to operate the parallel combination 30. In yet another aspect, the cooking vessel 18 may be physically separated from the coils 24, 26 by an insulating space 48 which may be filled with a non-conductive material, for example, a glass-ceramic plate or air. In a further aspect, an additional space 50 may be provided between the coils 24, 26.

Figure 2:
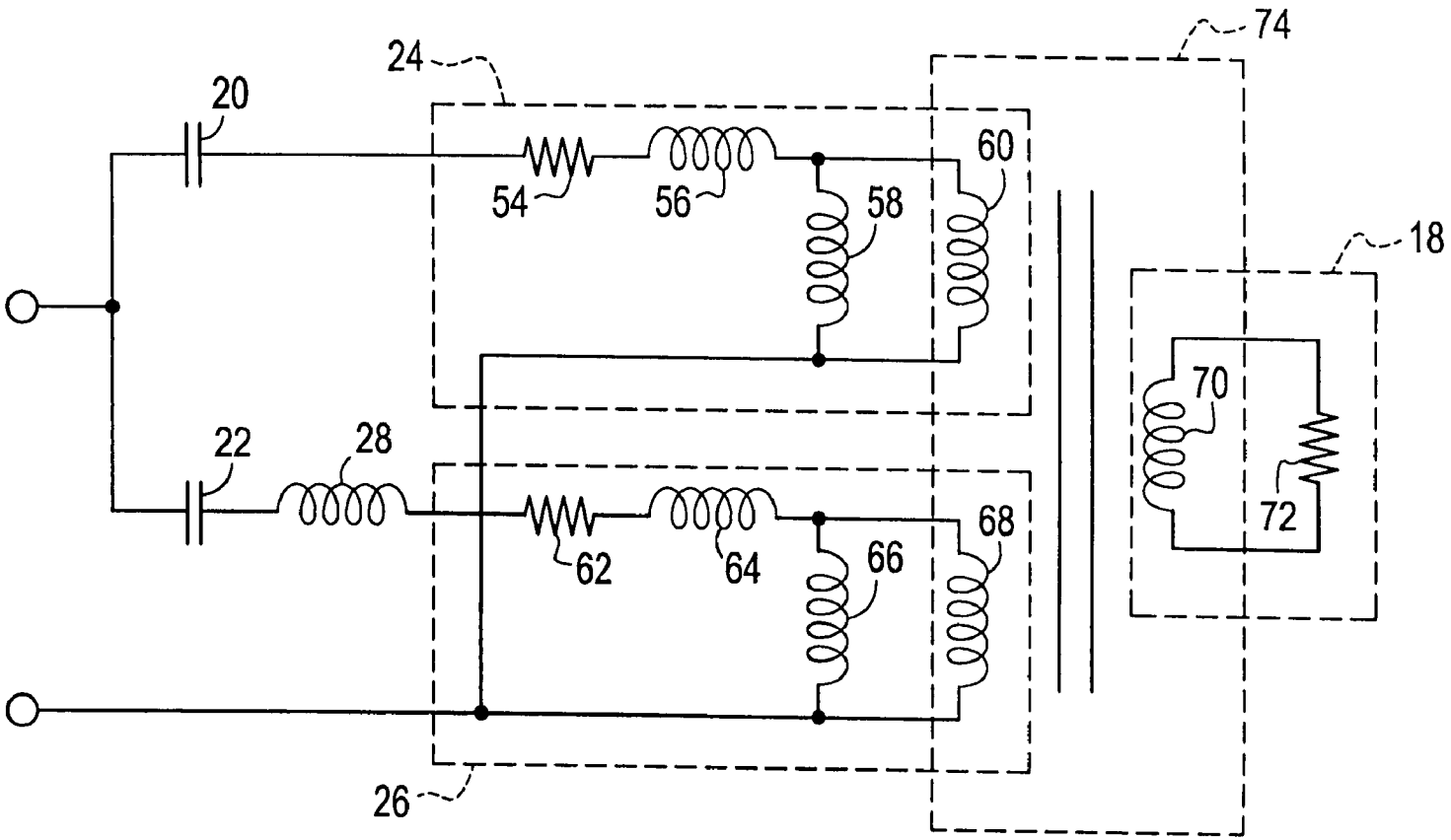
FIG. 2 is an exemplary equivalent lumped element magnetic circuit model of the dual coil induction cooking system of FIG. 1.

FIG. 2 is an exemplary equivalent lumped element magnetic circuit model of the dual coil induction cooking system of FIG. 1. Coil 24 includes a coil resistance 54 representing losses in coil 24, a spacing inductance 56 representing an impedance corresponding to the space 48 between the cooking vessel 18 and the coil 24, a magnetizing inductance 58 representing the inductance of the coil 24, and a non-ferrous metal cooking vessel primary turn portion 60. Coil 26 includes a coil resistance 62 representing losses in coil 26, a spacing inductance 64 representing an impedance corresponding to a total distance of the spaces 48, 50 between the cooking vessel 18 and the coil 26, a magnetizing inductance 66 representing the inductance of the coil 24, and a non-ferrous metal cooking vessel primary turn portion 68. Together, primary turn portions 60, 68 form a primary side of a transformer 74 representing the coupling mechanism of the induction cooking system. The cooking vessel 18 includes a load resistance 72, representing the cooking vessel dissipation, and a secondary turn portion 70 of the transformer 74. For example, the secondary turn portion 70 may include one turn.

In an aspect of the invention, the design of each of the coils 24, 26, such as the number of turns in the coil 24, 26 and the choice of capacitors 20, 22, or other components in each of the resonant circuits, such as inductor 28, are selected to ensure that each resonant circuit 12, 14 has a different resonant frequency. Accordingly, depending on the frequency of the voltage applied to the parallel combination 30, one of the resonant circuits 12, 14, tuned to the frequency of the voltage applied, will be relatively more active than the other resonant circuit 14, 12, tuned to a different frequency, for heating a cooking vessel 18, such as a pot, pan, skillet or any electrically conductive cooking device adapted for use on a stove top. For example, if a ferrous metal type cooking vessel 18 is placed above the coils 24, 26, the frequency source 16 provides an alternating voltage to the parallel combination 30 at the same frequency as the resonant frequency of the ferrous metal resonant circuit 14 to excite the circuit 14. The resonant frequencies of each of the resonant circuits 12, 14 may be selected based on optimal induction performance for each of the types of metal of the cooking vessels 18, and the difference between the resonant frequencies may be selected to ensure that one of the resonant circuits 12, 14 is excited depending on the type of cooking vessel 18 placed above the parallel combination 30 of resonant circuits 14,12.

In the past, dual coil induction cooking systems have been used to accommodate non-ferrous and ferrous metal cooking vessels. In such systems, the coils are typically switched in or out of an energizing circuit, for example, by means of a relay, depending on the metal type of cooking vessel being used. However, these designs have suffered from the unreliable nature of the switching mechanism, the high current necessary to drive the coils, and the heating of the switch contacts due to the relatively high frequency of the current required to drive the coils. The inventors of the present invention have advantageously recognized that by tuning the ferrous metal series resonant circuit 14 to resonate at one frequency, and by tuning the non-ferrous metal series resonant circuit 12 to resonate at a different frequency, the operating frequency of the frequency source 16 can be changed to accommodate ferrous and non-ferrous cookers 18, without requiring any electromechanical switching of voltage applied to the coils 24, 26. By innovatively using the low impedance characteristics of the resonant circuits 12, 14 at their respective resonant frequencies, and by matching those resonant frequencies to respective loads presented by ferrous and non-ferrous metal cooking vessels 18, power can be efficiently transferred to the load from the appropriate resonant circuit 12, 14 selected by the frequency of voltage applied to the parallel combination 30 of the resonant circuits 12, 14.

For example, one of the resonant circuits 14 may be configured to operate with high permeability cooking vessels 18 of relatively low electrical conductivity, such as ferrous cooking vessels including cast iron. The other resonant circuit 12 may be optimized for low permeability, high conductivity metals such as aluminum or copper. The resonant circuits 12,14 may be configured so that one of the circuits 12,14 dominates behavior of the parallel combination 30 when operated at a corresponding resonating frequency selected for coupling energy to a matched cooking vessel 18. Furthermore, for electrical loads having both ferrous and non ferrous properties, such as medium permeability metals with moderate conductivity or laminated combinations of ferrous and non-ferrous metals, power may be efficiently coupled by using both circuits by operating at an intermediate frequency. Advantageously, unlike previous dual coil designs, no switching device between the coils 12, 14 is required when changing from one type of cooking vessel metal 18 to another. A single inverter 32 may be used to drive both types of loads at comparable voltages, and the frequency of operation of the power source 16 may be changed to power different types of electrically conductive cooking vessels 18.

In an aspect of the invention, the non-ferrous metal cooking vessel coil 24 may be placed above the ferrous metal cooking vessel coil 26, and the cooking vessel 18 may be placed above the non-ferrous metal cooking vessel coil 24. For example, the circuit 10 may be incorporated into a stove, wherein the coils 24, 26 are positioned in the stove top to allow placing the cooking vessel 18 over the coils 24,26. The resonant circuits 12, 14 may be wired in parallel with the power source 16. In another aspect, the coils 24, 26 may be wound to occupy the same volume, for example, by interleaved or multi-filar winding. It should be understood that a skilled artisan may modify the above described arrangements using different circuits and circuit devices without departing from the scope of the present invention.

The power source 16 may include an inverter 32 for converting a direct current source into an alternating current at a desired frequency. In an aspect of the invention, the inverter may operate at a voltage level of approximately 80 volts. The power source 16 may further include a detector 34 for monitoring the power provided by the source, such as by measuring the current or voltage supplied to the parallel combination 30. By monitoring the power, the detector 34 can recognize when the parallel combination 30 is operating at a resonant frequency, such as by detecting an increase in current drawn from the inverter 32 when one of the resonant circuits 12, 14 is coupled to a load. The detector 34 may further include a feedback signal 36 to the inverter 32 to allow the inverter 32 to select an operating frequency based on a current measurement from the detector 34. The power source 16 may further include a frequency varying circuit 38, using for example, a voltage controlled oscillator, to variably control the operation frequency of the inverter 32. In another form, the inverter 32 may be operated at two frequencies, such as 20 kilohertz and 95 kilohertz.

Figure 3:
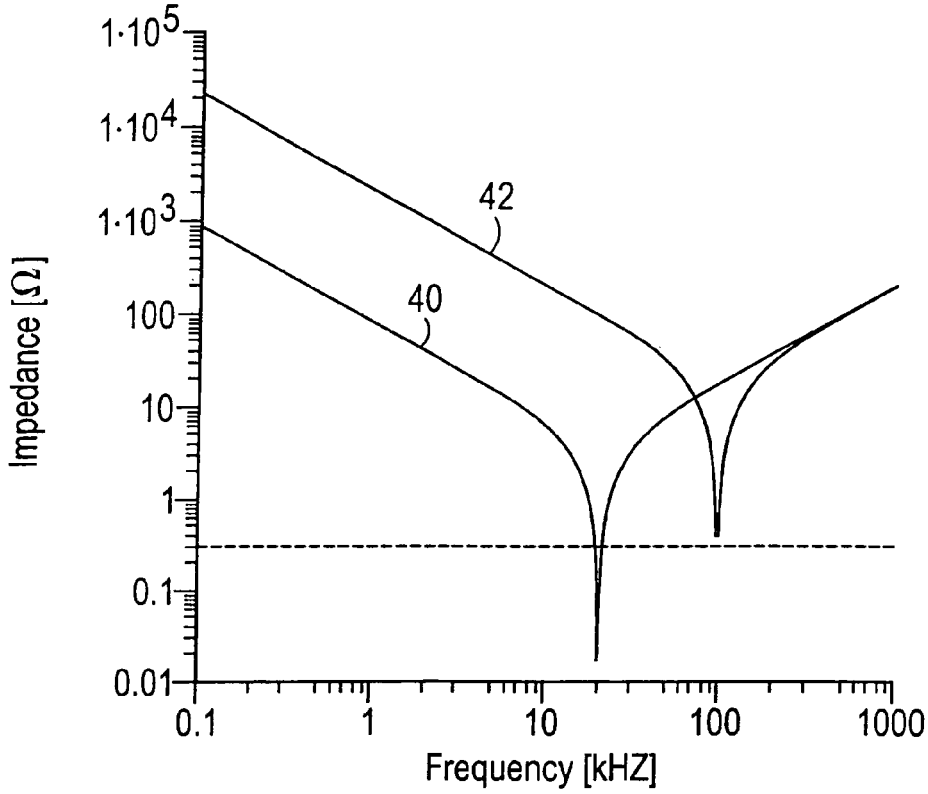
FIG. 3 is a graph of an exemplary parallel combination impedance versus frequency response for an aluminum cooking vessel using the dual coil induction cooking system of FIG. 1.

FIG. 3 is a graph of exemplary parallel combination impedance versus frequency response for an aluminum (non-ferrous) cooking vessel using the dual coil induction cooking system of FIG. 1. The inventors have determined that a frequency of 20 kilohertz may be suited for heating ferrous metal cooking vessels, and a frequency of 95 kilohertz may be suited for heating non-ferrous metal cooking vessels. The impedance response curve 40 for the ferrous metal resonant circuit exhibits a low impedance point at a resonant frequency of 20 kilohertz, while the impedance response curve 42 for the non-ferrous metal resonant circuit exhibits a low impedance point at a resonant frequency of 95 kilohertz. Accordingly, one efficient operating frequency (e.g., a point of reduced impedance, such as 0.4 ohms) for an aluminum cooking vessel may be 95 kilohertz. In contrast, the impedance response curve for the ferrous metal resonant circuit 40 is relatively lower (e.g., about 12 milli-ohms) at 20 kilohertz compared to the impedance of the non-ferrous metal resonant circuit 12. As a result, the non-ferrous metal resonant circuit 12 can couple power to the aluminum cooker more efficiently than the ferrous metal resonant circuit 14 at 95 kilohertz.

Figure 4:
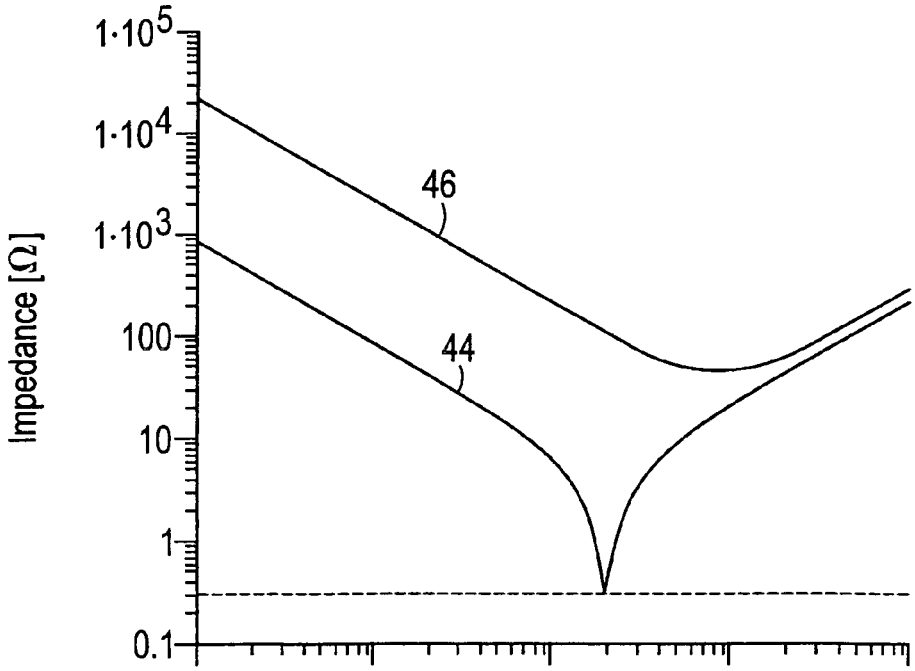
FIG. 4 is a graph of an exemplary parallel combination impedance versus frequency response for an iron cooking vessel using the dual coil induction cooking system of FIG. 1.

FIG. 4 is a graph of exemplary parallel combination impedance versus frequency response for an iron (ferrous) cooking vessel using the dual coil induction cooking system of FIG. 1. The impedance response curve 44 for the ferrous metal resonant circuit exhibits a low impedance point at a resonant frequency of 20 kilohertz, while the impedance response curve 46 for the non-ferrous metal resonant circuit exhibits a low impedance point at a resonant frequency of 95 kilohertz. Accordingly, one efficient operating frequency (e.g., a point of reduced impedance, such as 0.3 ohms) for an iron cooking vessel may be 20 kilohertz. In contrast, the impedance response curve 46 for the non-ferrous metal resonant circuit is relatively greater (e.g., about 100 ohms) at 95 kilohertz compared to the impedance of the ferrous metal resonant circuit 14. As a result, the ferrous metal resonant circuit 14 can couple power to the iron cooker more efficiently than the non-ferrous metal resonant circuit 12 at 20 kilohertz.

The inventors have further realized that by measuring the impedance response of the parallel combination 30 of resonant circuits 12,14, the type of cooking vessel 18 placed above to the cooking coils 24, 26 can be detected. For example, a method of detecting the presence and type of cooking vessel 18 placed above the coils 24, 26 may include sweeping the parallel combination 30 of the resonant circuits 12, 14 with a variable frequency source, for example at a comparatively lower voltage level than used for cooking, and detecting impedance versus frequency response. For example, the parallel combination 30 may be frequency swept to detect a comparatively rapid increase in current in the parallel combination 30 corresponding to coupling between the load and at least one of the resonant circuits 12, 14. In an aspect of the invention, the parallel combination 30 may be frequency swept from a first sweeping frequency to a second sweeping frequency until a resonance condition, such as a current spike, is detected. In a form of the invention, the first sweeping frequency is greater than a second sweeping frequency. In another form, the first sweeping frequency is less than a second sweeping frequency. In another aspect of the invention, a threshold impedance value may be set to reject detected impedance values greater than, or less than, the threshold impedance. Once a resonant condition is detected, the induction cooker may be operated at the frequency that corresponds to the detected resonance condition.

For example, with regard to FIG. 3, if an aluminum cooking vessel 18 is placed above the coils 24, 26 and the power source 16 sweeps from the first sweeping frequency, the circuit 10 will detect a resonance condition at 95 Kilohertz, indicating that an aluminum cooking vessel 18 has been placed above the coils 24, 26 and that the induction cooking system should be operated at 95 kilohertz for optimum coupling of power to the aluminum cooking vessel 18. In another aspect, with regard to FIG. 4, if an iron cooking vessel 18 is placed above the coils 24, 26 and the power source 16 sweeps from the first sweeping frequency, the circuit 10 will detect a resonant condition at 20 kilohertz instead of 95 kilohertz, indicating an iron cooking vessel 18 has been placed adjacent to the coils 24, 26 and that the cooking system should be operated at 20 kilohertz for optimum coupling to the iron cooking vessel 18.

While the preferred embodiments of the present invention have been shown and described herein, it will be obvious that such embodiments are provided by way of example only. Numerous variations, changes and substitutions will occur to those of skill in the art without departing from the invention herein. In particular, it should be appreciated by one skilled in the art that the invention could be used for induction heating of any metallic load, such as in industrial applications requiring heating of various types of metals or metallic alloys having different conductive properties. For example, the invention could be used in metallurgical applications, such as smelting, forging, and tempering. Accordingly, it is intended that the invention be limited only by the spirit and scope of the appended claims.

We claim as our invention:

1. A system comprising:

a first resonant circuit branch having a first resonant frequency;

a second resonant circuit branch having a second resonant frequency different from the first resonant frequency; and a frequency power source communicably connected in parallel to the first and the second resonant circuit branches so as to simultaneously provide power to each of the first and the second resonant circuit branches and so that at least one of the first and the second resonant circuit branches resonates to induce a heating circuit in a load based on a load type, wherein the power source includes a frequency varying circuit for sequentially varying a frequency of power provided to the first and the second resonant circuit branches.

2. The system of claim 1, wherein the load is a metallic load.

3. The system of claim 1, wherein the first resonant circuit branch further comprises a first capacitor and a first coil wired in series.

4. The system of claim 3, wherein the first resonant circuit branch further comprises an inductor wired in series with the first capacitor and the first coil.

5. The system of claim 1, wherein the second resonant circuit branch comprises a second capacitor and a second coil wired in series.

6. The system of claim 5, wherein the second resonant circuit branch further comprises an inductor wired in series with the second capacitor and the second coil.

7. The system of claim 1, wherein the power source is configured to operate at a first frequency and a second frequency.

8. The system of claim 1, wherein the power source is configured to operate at an intermediate frequency between a first frequency and a second frequency.

9. The system of claim 1, wherein the frequency varying circuit is configured to vary a frequency of power provided to the first and the second resonant circuit branches from a comparatively higher frequency to a comparatively lower frequency.

10. The system of claim 1, wherein the frequency varying circuit is configured to vary a frequency of power provided to the first and the second resonant circuit branches from a comparatively lower frequency to a comparatively higher frequency.

11. The system of claim 1, wherein the power source further comprises a detector for identifying at least one resonant frequency of the first or the second resonant circuit branches.

12. The system of claim 11, wherein the frequency varying circuit detects a condition corresponding to a predefined frequency, and wherein the system operates at the predefined frequency to optimally couple power to a cooking vessel.

13. A system comprising:

a first resonant circuit branch having a first resonant frequency;

a second resonant circuit branch having a second resonant frequency different from the first resonant frequency; and a frequency power source communicably connected in parallel to the first and the second resonant circuit branches so as to simultaneously provide power to each of the first and the second resonant circuit branches and so that at least one of the first and the second resonant circuit branches resonates to induce a heating circuit in a load based on a load type, wherein the power source is configured to operate at an intermediate frequency between a first frequency and a second frequency.

* * * * *